US009803420B2

(12) United States Patent
Ronchetti

(10) Patent No.: US 9,803,420 B2
(45) Date of Patent: Oct. 31, 2017

(54) CLOSING ELEMENT FOR ROLLER SHUTTER AND MOVABLE WALL FOR ROLLER SHUTTER COMPRISING THE CLOSING ELEMENT

(71) Applicant: Masinara S.p.A., Valsamoggia (IT)

(72) Inventor: Alessandro Ronchetti, Castel d'Aiano (IT)

(73) Assignee: MASINARA S.P.A., Valsamoggia (IT)

( * ) Notice: Subject to any disclaimer, the term of this patent is extended or adjusted under 35 U.S.C. 154(b) by 0 days.

(21) Appl. No.: 15/012,389

(22) Filed: Feb. 1, 2016

(65) Prior Publication Data

US 2016/0230450 A1 Aug. 11, 2016

(30) Foreign Application Priority Data

Feb. 6, 2015 (IT) ..... BO2015A0047

(51) Int. Cl.
*E06B 9/15* (2006.01)
*E06B 9/06* (2006.01)
*E06B 9/17* (2006.01)

(52) U.S. Cl.
CPC ..... *E06B 9/15* (2013.01); *E06B 9/0638* (2013.01); *E06B 9/17* (2013.01); *E06B 2009/1505* (2013.01); *E06B 2009/1566* (2013.01)

(58) Field of Classification Search
CPC ..... E06B 9/15; E06B 9/17; E06B 2009/1505; E06B 2009/1566; E06B 9/0638
USPC ..... 160/133, 235
See application file for complete search history.

(56) References Cited

U.S. PATENT DOCUMENTS 4,836,264 A * 6/1989 Machin ..... E06B 9/40 160/120
4,860,813 A * 8/1989 Ballyns ..... B60J 5/125 160/188
4,924,932 A * 5/1990 Esnault ..... E05D 15/12 160/201
5,188,161 A * 2/1993 Erber ..... E06B 9/34 160/133
5,456,305 A * 10/1995 Snarli ..... E06B 3/481 160/133

(Continued)

FOREIGN PATENT DOCUMENTS

DE 2801786 A1 * 7/1979
GB 1293236 A * 10/1972

(Continued)

OTHER PUBLICATIONS

Italian Search Report dated Jul. 23, 2015 for related Italian Application No. BO20150047.

*Primary Examiner* — Blair M Johnson
(74) *Attorney, Agent, or Firm* — Shuttleworth & Ingersoll, PLC; Timothy J. Klima

(57) ABSTRACT

A closing element for roller shutters comprising a central portion designed to be arranged, in use, according to a closing plane of an access opening of a room to at least partly close the access opening, and at least two connecting portions located on opposite edges of the central portion, each of which designed for connection of the closing element with at least one other closing element. Each connecting portion extends about a respective axis and defines a cavity for housing a connecting bar. The connecting portion has an open profile so that the cavity is accessible transversely to the axis.

11 Claims, 6 Drawing Sheets

(56) References Cited

U.S. PATENT DOCUMENTS 5,472,037 A * 12/1995 Hoffman ..... E05D 7/009 160/118
5,915,446 A * 6/1999 De Zen ..... E05D 15/242 16/269
6,041,846 A * 3/2000 Langlois ..... B60J 5/14 16/267
6,041,847 A * 3/2000 Lai ..... E06B 3/485 160/235
6,189,593 B1 * 2/2001 Katchur ..... E06B 9/18 160/133
6,302,179 B1 * 10/2001 Miller ..... E06B 9/165 160/133
6,672,362 B1 * 1/2004 Mullet ..... E05D 15/165 16/225
6,951,237 B2 * 10/2005 Mullet ..... E05D 15/24 160/133
7,328,613 B2 * 2/2008 Volkel ..... E06B 9/15 160/232
2006/0118251 A1 * 6/2006 Miller ..... E06B 9/78 160/133
2006/0283563 A1 * 12/2006 Volkel ..... E06B 9/15 160/236
2007/0062650 A1 * 3/2007 Rejc ..... E06B 9/08 160/133
2010/0078135 A1 * 4/2010 Alvarez ..... E05D 15/242 160/207
2010/0236727 A1 * 9/2010 Hall ..... E06B 9/15 160/133
2015/0368962 A1 * 12/2015 Motosko ..... E06B 9/15 160/107
2016/0230450 A1 * 8/2016 Ronchetti ..... E06B 9/15

FOREIGN PATENT DOCUMENTS

GB 2189285 A 10/1987
NL 6408873 A 2/1966
WO WO9633333 A1 10/1996

* cited by examiner

CLOSING ELEMENT FOR ROLLER SHUTTER AND MOVABLE WALL FOR ROLLER SHUTTER COMPRISING THE CLOSING ELEMENT

This application claims priority to Italian Patent Application BO2015A000047 filed Feb. 6, 2015, the entirety of which is incorporated by reference herein.

BACKGROUND OF THE INVENTION

This invention relates to a closing element for a roller shutter as well as a movable wall for a roller shutter comprising the closing element.

More specifically, the closing elements for a roller shutter to which reference is made are those used in the field of elements for closing accesses or rooms (such as, for example, garages, shops, workshops, etc.) for making closing systems, including roller shutters.

Roller shutters usually comprise:

a shaft positioned at the upper end of the opening of the access to be closed and fixed to a pair of plates are associated with (connected) to the corresponding vertical wall delimiting the opening of the access;

a movable "sheet" (or wall) associated with the shaft and which can be wound about the shaft, which may, if required, slide in lateral guides positioned on the vertical walls delimiting the opening of the access;

a motor for driving the shaft, to open and close the access opening.

The movable sheet usually comprises a succession of closing elements of elongate shape, and generally positioned in a horizontal direction, and a series of longitudinal bars which are inserted one at a time into respective connecting sockets made along the longitudinal edges of the plate-like closing elements.

In this way it is possible to slide each bar inside the sockets, aligned with each other, of pairs of consecutive plate-like closing elements. By repeating this procedure it is possible to obtain a longitudinal link and plate-like closing elements which define the movable sheet for the roller shutter.

Moreover, there are solutions wherein each closing element may be in turn defined by a series of closing elements aligned in a horizontal direction, in which the closing elements of each row are all connected, on each side, to a respective common connecting bar.

In this configuration, connecting rods may also be interposed between one closing element and the next having at the relative ends ring-shaped passages to be inserted on the longitudinal bars.

In order to fit the movable sheet the operator must make a link according to a precise predetermined pattern, by inserting in a sliding fashion each plate-like closing element and/or each connecting mechanism on the basis of a sequential assembly order proceeding by rows.

An error during installation, or a change during the operations, may result in the need to remove the link and repeat the installation operations from the beginning.

Once installed, in the case of maintenance, if a plate-like closing element or a connecting mechanism must be replaced it is necessary to withdraw at least the row in which piece to be replaced is located and then refit the row by reinserting the pieces removed; these operations, as well as being laborious, require considerable time.

Moreover, each installation of existing roller shutters are made with movable sheets only having longitudinal bars and connecting bars. These solutions leave the shutter equipped with a mainly open part, leaving the space behind on view.

If for any reason a user wanted the sheets of these shutters to be fitted with plate-like closing elements, for example to prevent a third party from throwing objects or inserting their hands through the shutter from an environment outside the access to one inside, the movable sheet would ned to be removed completely to be able to insert a plate-like closing element of the type described above between one connecting rod mechanism and the next.

SUMMARY OF THE INVENTION

In this context, the technical purpose which forms the basis of this invention is to provide a closing element for a roller shutter and a sheet for a roller shutter comprising the closing element which overcomes one or more of the above mentioned drawbacks of the prior art.

More specifically, the aim of this invention is to provide a closing element for a roller shutter which is structurally simple and easy to install.

A further aim of this invention is to provide a closing element for roller shutters which is versatile and which can be used to improve existing closing systems.

The technical purpose indicated and the aims specified are substantially achieved by a closing element of a roller shutter comprising technical features described herein.

More specifically, this invention comprises a closing element for roller shutters comprising a central portion designed to be arranged, in use, according to a closing plane of an access opening of a room to at least partly close the access opening, and at least two connecting portions located on opposite edges of the central portion, each of which designed for connection of the closing element with at least one other closing element.

Each connecting portion extends about a respective axis and defines a cavity for housing a connecting bar.

The connecting portion has an open profile in such a way that the cavity is accessible transversely to the axis.

This invention also relates to a movable sheet for a roller shutter which is easily modular using closing elements which can be quickly fitted and removed and which can be adapted in a simple and fast fashion to the requirements of the user.

More specifically, this invention comprises a movable sheet for a roller shutter comprising a plurality of a closing elements for a roller shutter according to this invention and a plurality of connecting bars.

Each connecting bar is engaged inside at least one connecting portion of a first closing element and at least one connecting portion of a second closing element to define a hinged connection between the first and second closing element.

The connecting portions of the first and second closing element are extractable from the connecting bar along a direction of extraction transversal to the axis defined by the connecting portions.

The dependent claims, incorporated herein for reference, relate to different embodiments of the invention.

BRIEF DESCRIPTION OF THE DRAWINGS

Further features and advantages of the invention are more apparent in the detailed description below, with reference to a preferred, non-limiting, embodiment of a closing element of a roller shutter and a sheet for a roller shutter as illustrated in the accompanying drawings, in which.

DESCRIPTION OF THE PREFERRED EMBODIMENTS

A sheet or movable wall (the words sheet or wall will be used below without distinction) for a roller shutter made according to the invention is indicated in its entirety in FIGS. 1, 2, 5, 6 with the numeral 100.

The movable sheet 100 is of the type designed to be wound on a shaft, positioned at the upper end of an access opening to be closed, and supported in use by at least a corresponding wall of the room delimiting the access opening.

The movable sheet 100 can be wound and unwound about the shaft to open and close, respectively, the access opening along a generally vertical closing plane.

Preferably, the movable sheet 100 is at least partly flexible for allowing the winding about the shaft.

The movement of the movable sheet 100 may be carried out using movement means of known type.

For example the movement means may be of a manual type (the user manually moves the movable sheet 100 from the bottom upwards or vice versa to open or close the access opening) or may comprise a motor unit for the automatic movement of the movable sheet 100 for unwinding and winding.

Preferably, the roller shutter comprises lateral guides, positioned vertically on the vertical walls at the intrados of the access opening, to guide the sliding of the lateral ends of the movable sheet 100 in the guides themselves during the winding and unwinding of the movable sheet 100.

It should be noted that the term "closing plane" refers to the plane delimited by the intrados of an access opening of a room, through which the user intends to allow or prevent access to the room.

Figure 3:
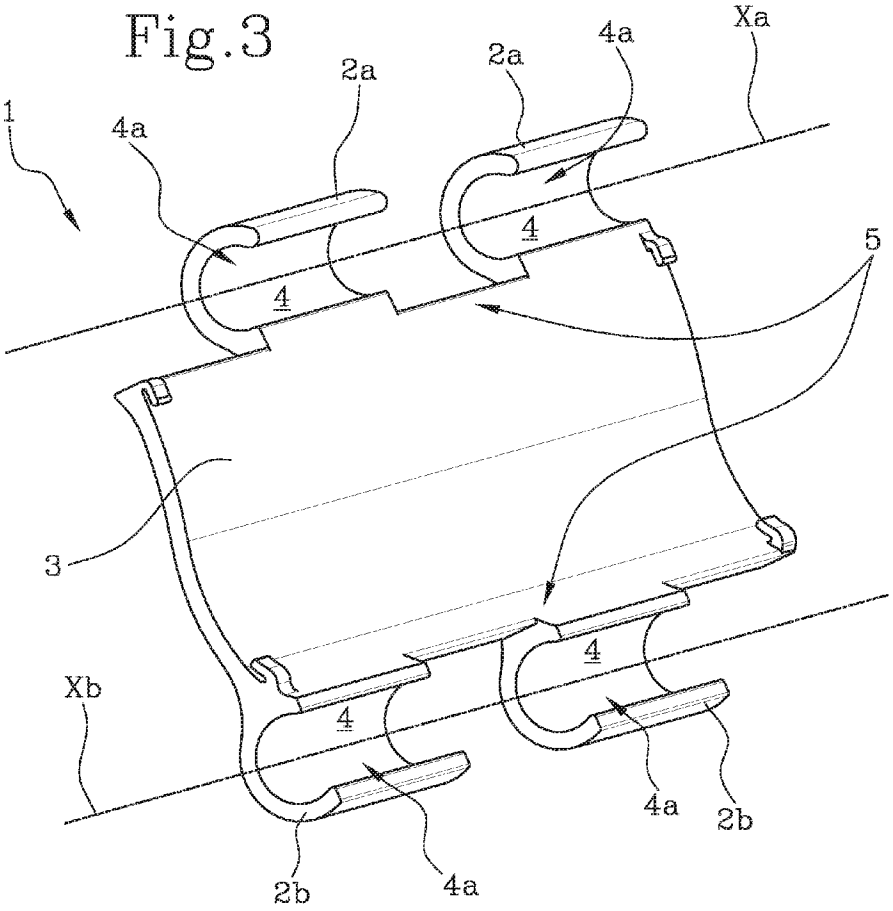
FIG. 3 is a schematic perspective view of a closing element for a roller shutter according to this invention.

With reference to FIG. 3, the movable sheet 100 for a roller shutter according to this invention comprises a plurality of closing elements 1 and a plurality of connecting bars 101 engaged to the closing elements 1, articulated to each other to define a complex configuration of the roller type.

Preferably, the connecting bars 101 are of tubular shape, preferably circular in cross section and still more preferably made of metal.

Preferably, the free ends of the connecting bar 101 are configured to slide inside the lateral guides (not illustrated) of the roller shutter.

Preferably, the connecting bar 101 is positioned in use inside the closing plane in such a way that a main axis of extension 102 of the connecting bar 101 lies in the closing plane.

With reference to the first embodiment of FIGS. 1 and 2, the sheet comprises a plurality of closing elements 1 positioned preferably on horizontal rows and positioned side by side horizontally on each row, and a plurality of connecting bars 101, wherein each connecting bar 101 is engaged simultaneously with a plurality of first closing elements 1 on one side (above), and a plurality of second closing elements 1 on the other side (below) to define a hinged connection between the first and second closing elements 1.

Figure 4:
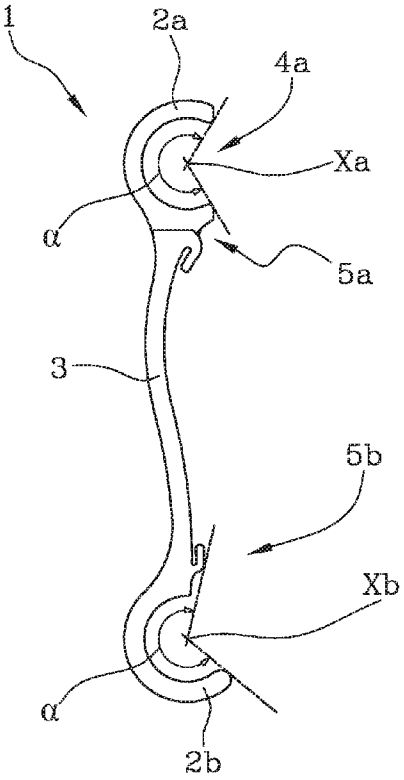
FIG. 4 is a schematic side view of the closing element of FIG. 3 according to the viewing direction K.

FIGS. 3 and 4 illustrate in detail the embodiment of the closing elements 1 according to this invention.

The closing element 1 comprises a central portion 3 and at least two connecting portions 2*a*, 2*b* positioned on opposite edges 5*a*, 5*b* of the central portion 3. Each connecting portion 2*a*, 2*b* is designed for connecting with at least another closing element 1 using a connecting bar 101.

The central portion 3 is designed to be positioned, in use, according to the closing plane of the access opening and preferably lies flat or substantially flat in such a way that the joining of a succession of closing elements 1 defines an extension to the roller sheet.

Each connecting portion 2 extends about a respective axis 'Xa', 'Xb' which are preferably rectilinear and preferably parallel to the closing plane.

Each connecting portion 2 defines a cavity 4 for housing the connecting bar 101.

With reference to the connecting portion (positioned above in use) labelled 2*a*, it should be noted that the portion is preferably locked (with interference) to the connecting bar 101.

For this reason, preferably, the internal diameter of the cavity 4 of the portion 2*a* is sized to allow a locking (with interference) of the connecting bar in the cavity 4.

With reference to the connecting portion (positioned below in use) labelled 2*b*, it should be noted that the portion is preferably coupled with clearance to the connecting bar 101.

For this reason, preferably, the internal diameter of the cavity 4 of the portion 2*b* is sized to allow a free coupling (with clearance) of the connecting bar 101 in the cavity 4.

It should be noted that the inside diameters of the cavity 4 of the first and second portions are different to each other.

Preferably, the two connecting portions 2*a*, 2*b* are shaped in reciprocally compatible manner so that they can align the axes 'Xa', 'Xb' of the connecting portions 2*a*, 2*b* of two identical adjacent closing elements 1, in a coupling configuration.

To accomplish this, the two connecting portions 2*a*, 2*b* are arranged on the closing element 1 in a position axially offset along the axes 'Xa', 'Xb'.

Advantageously, each connecting portion 2*a*, 2*b* at the cavity 4 has an open profile in such a way as to be accessible transversely to the axis 'Xa', 'Xb'.

In other words, the connecting portion 2*a*, 2*b* has a circumferential zone of discontinuity 4*a* defining the zone of transversal access to the cavity 4.

As the profile of the connecting portion 2*a*, 2*b*, is open transversely to the axis X, it allows the closing element 1 to be applied on the connecting bar 101 simply by fitting the cavity 4 transversely on the connecting bar 101, at the circumferential zone of discontinuity 4*a* of the connecting portion 2*a*, 2*b*.

Thanks to this invention, the cavity 4 is designed to receive the connecting bar 101 both transversely and longitudinally relative to the axis 'Xa', 'Xb'.

Figure 1:
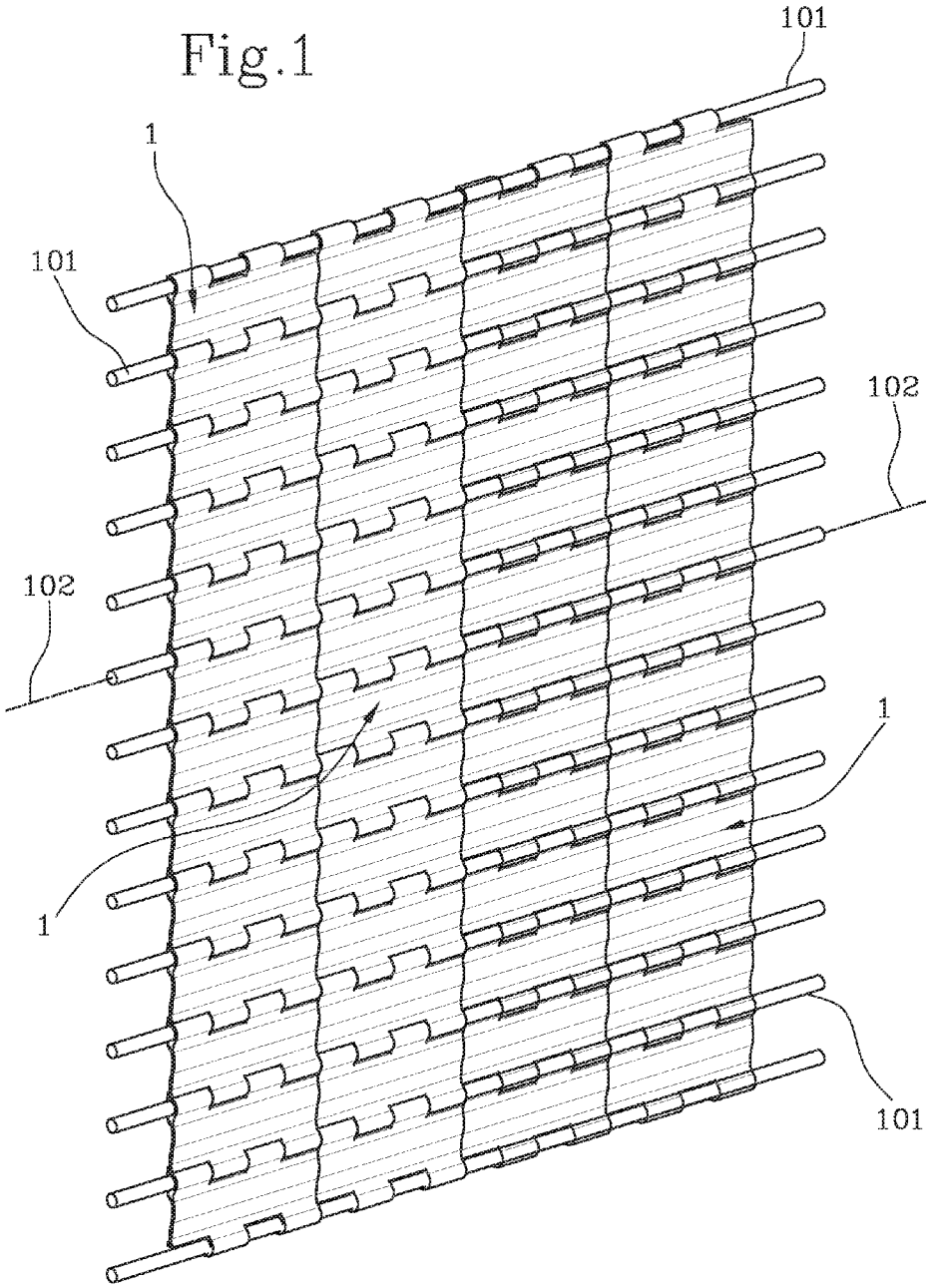
FIG. 1 is a schematic perspective view of a movable sheet for a roller shutter according to a first embodiment of this invention.
Figure 2:
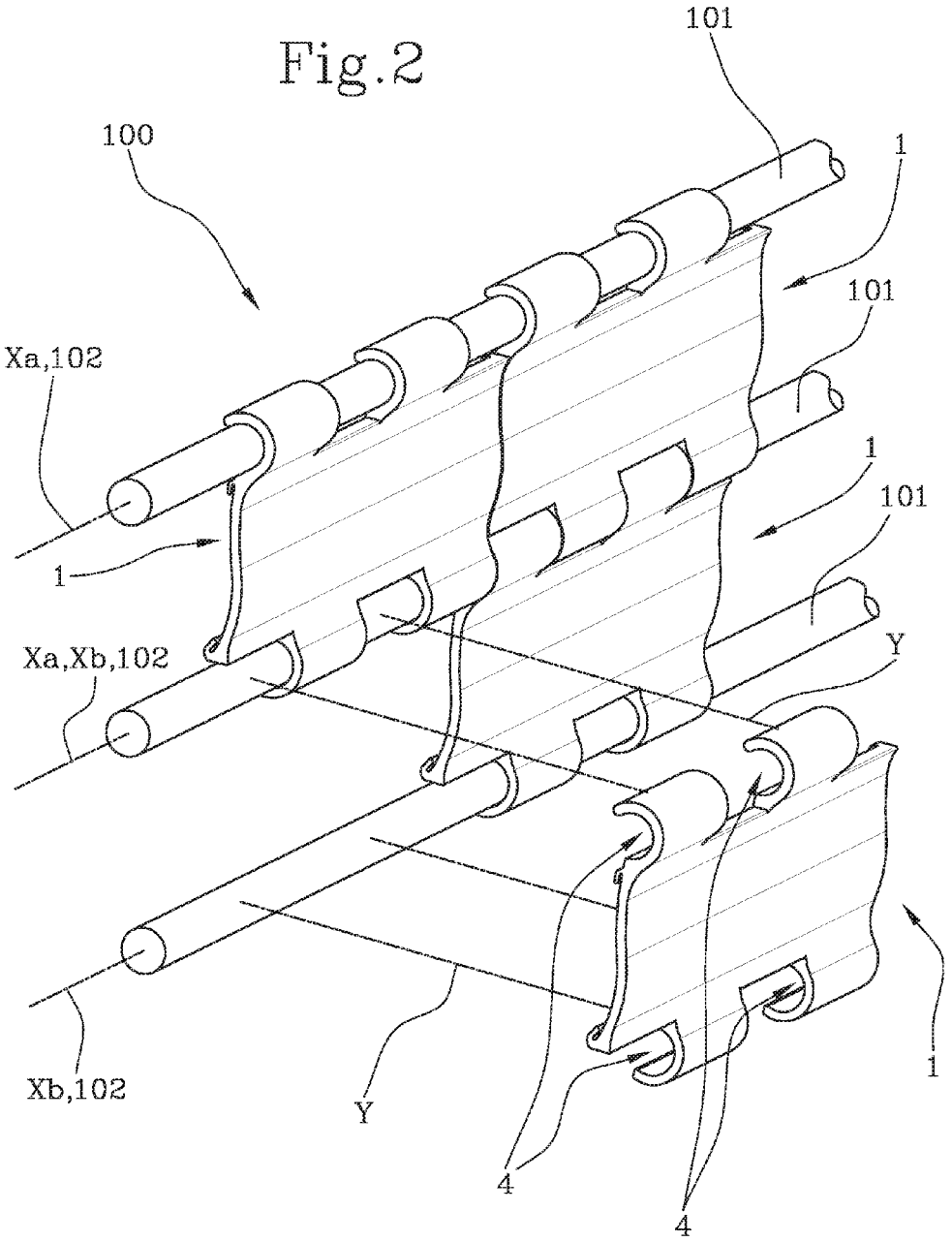
FIG. 2 is a schematic perspective view of a portion of a movable sheet of FIG. 1 during a fitting/removal step.

With reference to FIG. 1, each connecting bar 101 and the respective first and second closing elements 1 to which it is connected can be separated from each other along a direction of extraction "Y" substantially transversal to the axis 'Xa', 'Xb' defined by the connecting portions 2*a*, 2*b*.

In other words, each closing element 1 can be mounted on and removed from any connecting bar 101 simply by fitting the connecting portion 2 on the outer lateral surface of the connecting bar 101, thus without the need to remove the connecting bar 101 and insert each closing element 1 from a lateral free end of the connecting bar 101 along the axis 'Xa', 'Xb'.

Advantageously, if the user needs to replace one closing element 1 with another, or simply if it is necessary to remove it for routine maintenance and then refit it, it will not be necessary to remove the adjacent closing elements 1 but simply remove only the closing element 1 in question, thus saving considerably in terms of time needed for the intervention.

Preferably, the cavity 4 of the connecting portion 2 is designed to receive the connecting bar 101 in such a way that the main axis of extension 102 of the connecting bar 101 is positioned, in use, coincident with the axis 'Xa', 'Xb' of the connecting portion 2*a*, 2*b* of the closing element 1.

Preferably, moreover, the closing elements 1 are rotatably coupled to the respective connecting bars 101 in such a way that the connecting bars 101 form the bending zones of the sheet 100.

In this configuration, the cavity 4 is defined by a receiving surface defined by a cylindrical surface part inside the connecting portion 2.

With reference to FIG. 4, preferably the cylindrical surface part of the connecting portion 2*a*, 2*b* extends about the axis 'Xa', 'Xb' for an angle $\alpha$ of between 100° and 180° calculated in the cavity 4 between the ends of the circumferential zone of discontinuity 4*a*.

Preferably, the connecting portion 2*a*, 2*b* is elastically deformable in such a way as to allow a coupling and uncoupling in a snap-on fashion with the connecting bar 101.

In the embodiment of the closing element 1 illustrated in FIGS. 3 and 4, there are two connecting portions 2*a*, 2*b* on each edge 5*a*, 5*b*, having axes 'Xa', 'Xb' coincident; however, the number of connecting portions 2*a*, 2*b* could be greater than on the basis of the dimensional characteristics of the closing element 1.

Preferably, the connecting portions 2*a* positioned on an edge 5*a* of a closing element 1 are positioned in a complementary fashion to the connecting portions 2*b* of the other edge 5*b* of the closing element 1, in such a way that by coupling together identical closing elements 1 there is a snap-on connection between the connecting portions 2*a*, 2*b* of the two connecting elements 1, in particular each connecting portion 2*a* being positioned in the space formed between the connecting portions 2*b* of the other closing element 1.

Advantageously, in this way the closing element 1 may also be fitted upside down further simplifying the installation operations; however it is also possible to make different reasons textures and patterns in the link which makes up the movable sheet 100.

In this regard, it should be noted that the element 1 can advantageously be made of different colors and textures and with different materials to produce customizable graphical patterns and effects according to the requirements of the user.

Thanks to this invention, the user can obtain a movable sheet 100 which is able to improve the appearance of the relative access opening (for example, shop windows).

Moreover, it is possible to apply on the central portion 3 of the closing element logos and brands to make the movable sheet 100 even more customized.

Preferably, the closing element 1 is configured as a single-block element, however in embodiments not illustrated in the accompanying drawings it is possible that the connecting portion 2 is engaged to the central portion 3 by interposing a fixing element which rotatably couples the two components.

Preferably, the closing element 1 or the central portion 3 are made of plastic material.

Preferably, the closing element 1 or the central portion 3 are transparent; this aspect may be advantageous for particular applications in which the user wants to make the environment inside the access opening open to view (for example a display window) during a closed configuration of the movable sheet 100 in which access is prevented (for example during closing times).

According to the embodiment of the closing element 1 illustrated in the drawings, the central portion 3 preferably has a convex cross section towards the closing plane.

Figure 5:
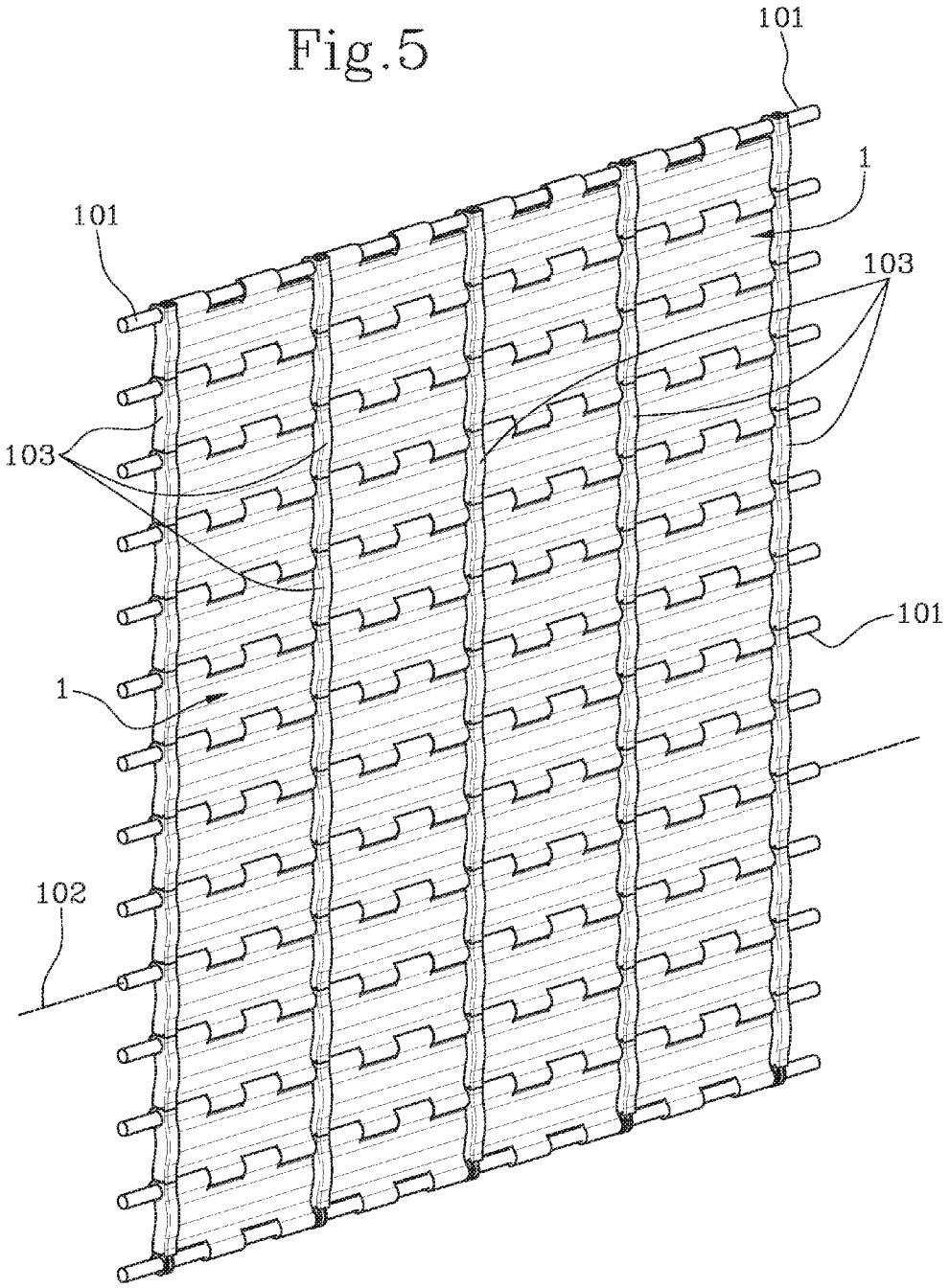
FIG. 5 is a schematic perspective view of a movable sheet for a roller shutter according to a second embodiment of this invention.
Figure 6:
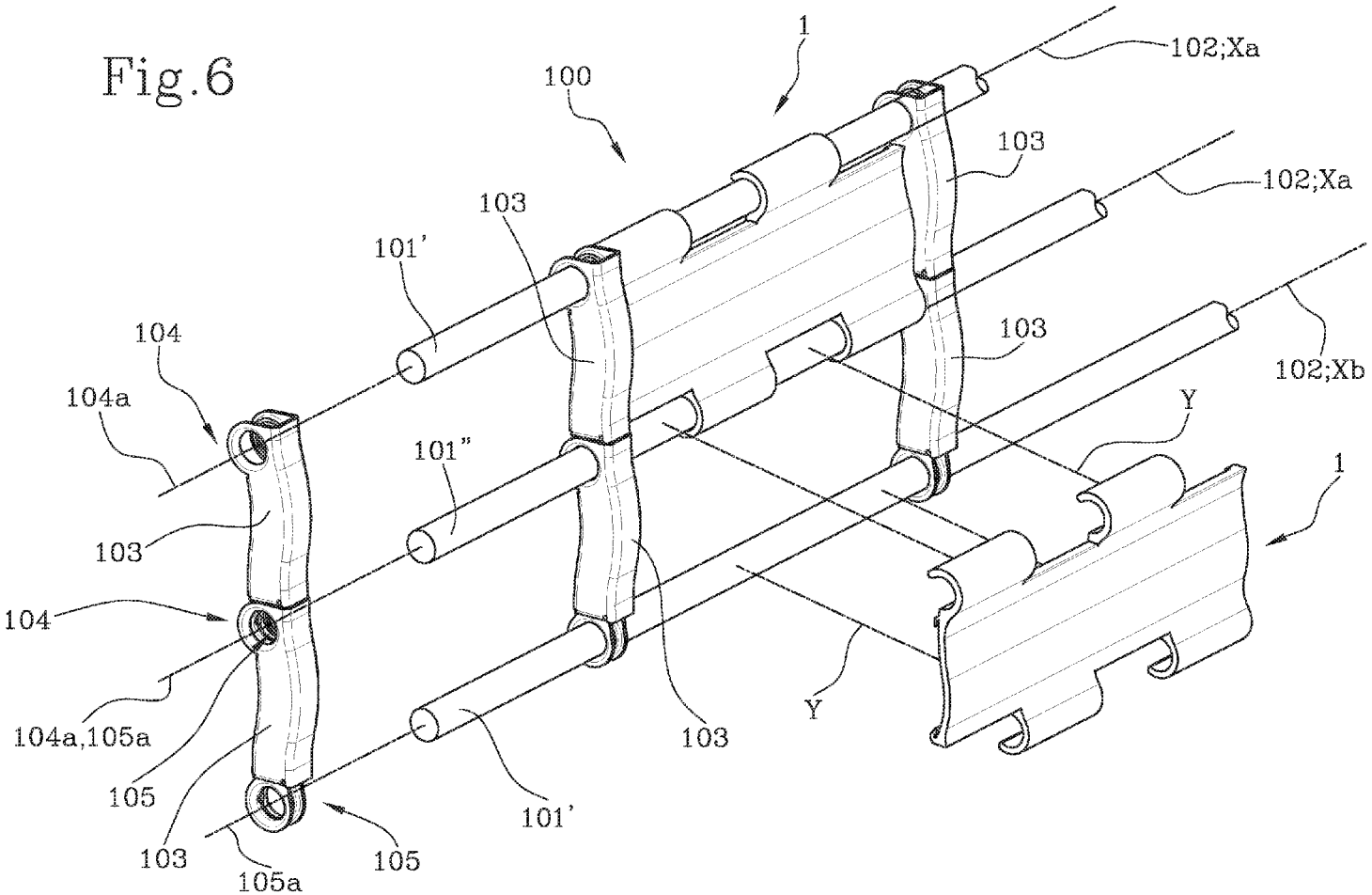
FIG. 6 is a schematic perspective view of a portion of a movable sheet of FIG. 5 during a fitting/removal step.
Figure 7A:
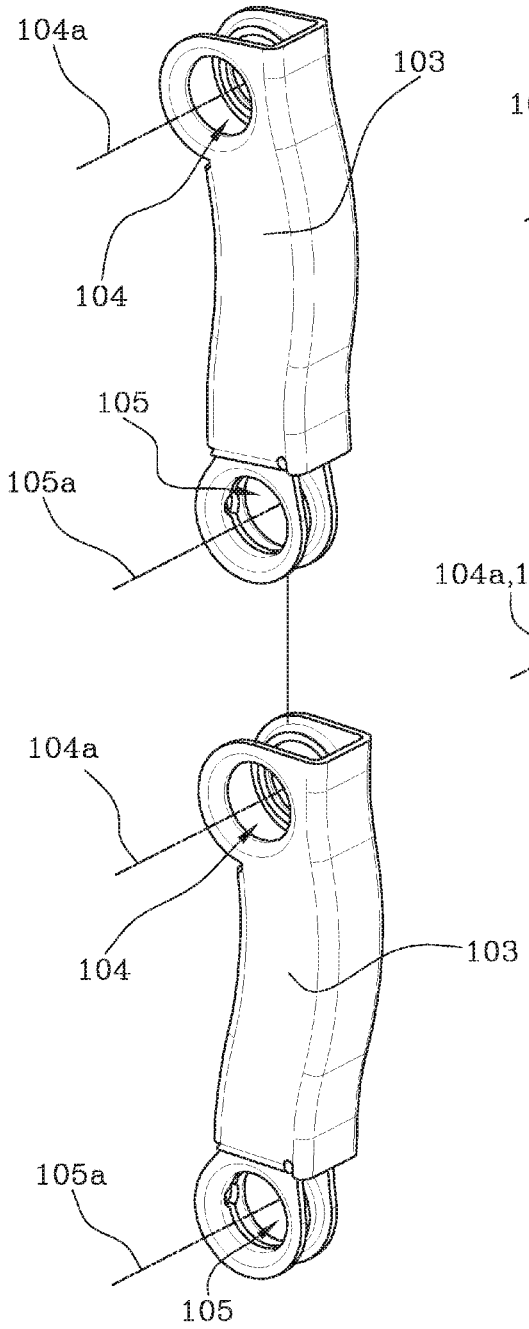
FIGS. 7A and 7B are two schematic perspective views, respectively, of a stiffening element for a roller shutter in an assembled configuration and in a non-assembled configuration.
Figure 7B:
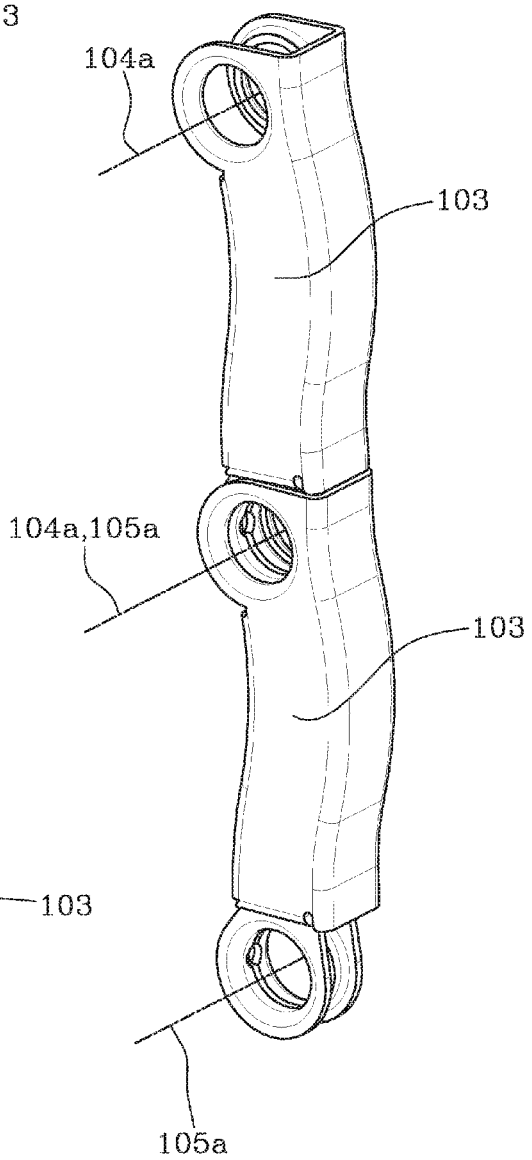

With reference to a second embodiment of the movable sheet 100 illustrated in FIGS. 5 and 6, the movable sheet 100 comprises at least one stiffening element 103, as better illustrated in detail in FIGS. 7A and 7B, having a first seat 104 and a second seat 105 designed to receive rotatably, respectively, a first connecting bar 101' and a second connecting bar 101" of the movable sheet 100 adjacent to each other.

Preferably, the seats 104, 105 have a circular cross-section in such a way that, if the connecting bars 101 have a circular cross-section, the first connecting bar 101' can rotate about a first axis of rotation 104*a* of the first seat 104 and that the second connecting bar 101" can rotate about a second axis of rotation 105*a* of the second cavity 105.

As illustrated in FIGS. 5 and 6 relative to the second embodiment of the movable sheet 100, the stiffening element 103 is positioned alongside at least one closing element 1 in order to stiffen the movable sheet 100 and define a more resistant structure of the roller shutter.

According to a possible embodiment of the stiffening element 103, not illustrated in the drawings, the first seat 104 and/or the second seat 105 define an open hook, in such a way that each stiffening element 103 can be fitted transversely on at least one of the connecting bars 101 (preferably but not necessarily in a snap-on fashion).

In this way it is possible to speed up the operations for fitting the movable sheet 100; moreover, it is possible to equip already existing movable sheets 100 with stiffening elements 103, without necessarily having to insert the seats 104, 105 from the ends of the connecting bars 101, but simply applying them transversely to the axis of extension 102 of the connecting bars 101.

As illustrated in FIGS. 7A, 7B, preferably the first seat 104 of a first stiffening element 103 can be inserted inside the second seat 105 of a second stiffening element 103, so that the two seats 104, 105 can be aligned on a same connecting bar 101, thus defining a hinged coupling between the stiffening elements 103.

According to this invention it is also possible to install a roller shutter having a movable sheet 100 defined by a plurality of connecting bars 101 and by a plurality of stiffening elements 103, in such a way as to make an open link structure which can be advantageously closed when necessary.

To increase the safety and/or the resistance of roller shutters equipped with a movable sheet 100 according to this invention, preferably each stiffening element 103 comprises fixing means, not illustrated in the accompanying drawings, positioned at least at one of the seats 104, 105 to achieve a retaining stable of the respective connecting bar 101 in the seat 104, 105 preventing a mutual sliding between the connecting bar 101 and the stiffening element 103.

For example, the fixing means can be screws or more preferably deformable fixing rings (open).

Advantageously, the deformable fixing rings are applicable to the respective stiffening elements 103 with considerable ease.

The present invention achieves the preset aims, overcoming the disadvantages of the prior art.

Advantageously, the closing element 1 according to this invention, unlike the prior art which comprises a laborious assembly of the closing elements on the longitudinal bars by a lateral insertion of the closing elements from a free end of the bar of the sockets (closed cavities) which, thanks to the presence of the connecting portions 2*a*, 2*b* with an open profile is characterized by a high degree of accessibility which allows a simple and fast fitting and removal during the installation or maintenance steps of the movable sheets 100.

The movable sheet 100 according to this invention is easily modular shaft thanks to the presence of simple and easily installable closing elements 1.

The closing element 1 is also advantageously adaptable to existing roller shutters, for example of the open mesh type wherein horizontal bars and vertical connecting rods delimit openings to allow the visibility of the environment separated by the shutter.

What is claimed is:

1. A movable closing wall for closing roller shutters, comprising:

a plurality of closing elements for closing roller shutters, each of the plurality of closing elements comprising:

a central portion adapted to at least partly close an access opening of a room, in use, according to a closing plane of the access opening of the room, at least two connecting portions arranged on opposite edges of the central portion, each of the at least two connecting portions adapted to couple with at least one further closing element, each of the at least two connecting portions extending about a respective axis and defining a cavity for housing a connecting bar;

wherein each of the at least two connecting portions has an open profile so that each cavity is accessible transversely to the respective axis;

wherein the open profile of each of the at least two connecting portions is defined by a circumferential opening and wherein each of the at least two connecting portions extends about the respective axis by an angle ranging between 100° and 180° and wherein each of the at least two connecting portions is elastically deformable so as to allow a snap-fit coupling and uncoupling with the connecting bar transversely to the respective axis;

a plurality of connecting bars, each of which is engaged inside at least one of the at least two connecting portions of a first closing element and at least one of the at least two connecting portions of a second closing element to define a hinged connection between the first and second closing element;

the at least two connecting portions of the first and second closing element being extractable from the connecting bars along a direction of extraction substantially transversal to an axis defined by the at least two connecting portions;

at least one stiffening element having a first seat and a second seat adapted to rotatably receive a first adjacent connecting bar and a second adjacent connecting bar, respectively, of the movable closing wall, the at least one stiffening element being arranged adjacent a side of at least one of the plurality of closing elements;

wherein the first seat of a first stiffening element can be inserted inside the second seat of a second stiffening element so that the two seats can be aligned on a same connecting bar, thus defining a hinged coupling between the first and second stiffening elements.

2. The movable closing wall according to claim 1, wherein each cavity has a receiving surface defined by a part of a cylindrical surface.

3. The movable closing wall according to claim 1, wherein the at least two connecting portions extend about parallel axes.

4. The movable closing wall according to claim 1, wherein the at least two connecting portions define cavities with different diameters.

5. The movable closing wall according to claim 1, wherein the at least two connecting portions are shaped in reciprocally compatible manner so that they can align the axes of the at least two connecting portions with at least two connecting portions of a further closing element adjacent the closing element, in a coupling configuration.

6. The movable closing wall according to claim 1, wherein the closing elements are rotatably coupled to the respective connecting bars.

7. The movable closing wall according to claim 1, wherein at least one chosen from the first seat and the second seat define an open hook so that each stiffening element may be fitted transversely on a pair of connecting bars.

8. The movable closing wall according to claim 1, wherein each stiffening element comprises deformable fixing rings arranged at least at one of the seats for retaining the stiffening element in the respective connecting bar, thus preventing a reciprocal sliding between the connecting bar and the stiffening element.

9. The movable closing wall according to claim 1, wherein the circumferential opening has a chord length less than a diameter of the connecting bar.

10. The closing element according to claim 1, wherein the circumferential opening has a chord length less than a diameter of the connecting bar.

11. A movable closing wall for closing roller shutters, comprising:

a plurality of closing elements for closing roller shutters, each of the plurality of closing elements comprising:

a central portion adapted to at least partly close an access opening of a room, in use, according to a closing plane of the access opening of the room, at least two connecting portions arranged on opposite edges of the central portion, each of the at least two connecting portions adapted to couple with at least one further closing element, each of the at least two connecting portions extending about a respective axis and defining a cavity for housing a connecting bar;

wherein each of the at least two connecting portions has an open profile so that each cavity is accessible transversely to the respective axis;

wherein the open profile of each of the at least two connecting portions is defined by a circumferential opening and wherein each of the at least two connecting portions extends about the respective axis by an angle ranging between 100° and 180° and wherein each of the at least two connecting portions is elastically deformable so as to allow a snap-fit coupling and uncoupling with the connecting bar transversely to the respective axis;

a plurality of connecting bars, each of which is engaged inside at least one of the at least two connecting portions of a first closing element and at least one of the at least two connecting portions of a second closing element to define a hinged connection between the first and second closing element;

the at least two connecting portions of the first and second closing element being extractable from the connecting bars along a direction of extraction substantially transversal to an axis defined by the at least two connecting portions;

at least one stiffening element having a first seat and a second seat adapted to rotatably receive a first adjacent connecting bar and a second adjacent connecting bar, respectively, of the movable closing wall, the at least one stiffening element being arranged adjacent a side of at least one of the plurality of closing elements;

wherein each stiffening element comprises deformable fixing rings arranged at least at one of the seats for retaining the stiffening element in the respective connecting bar, thus preventing a reciprocal sliding between the connecting bar and the stiffening element.

* * * * *